United States Patent [19]

Smith

[11] 4,230,321

[45] Oct. 28, 1980

[54] FAMILY RELATIONSHIPS CARD GAME

[76] Inventor: Mildred E. Smith, 1609 Madison St., NW., Washington, D.C. 20011

[21] Appl. No.: 37,887

[22] Filed: May 10, 1979

Related U.S. Application Data

[63] Continuation-in-part of Ser. No. 850,396, Nov. 10, 1977, abandoned.

[51] Int. Cl.[3] ..... A63F 1/00

[52] U.S. Cl. ..... 273/308; 35/21

[58] Field of Search ..... 273/292, 303, 306, 308; 35/21

[56] References Cited

U.S. PATENT DOCUMENTS

| | | | |
|---|---|---|---|
| 1,426,928 | 8/1922 | Tiencken | 273/308 |
| 1,528,061 | 3/1925 | Joyce | 273/299 X |
| 1,583,223 | 5/1926 | Cooke | 273/308 |
| 2,072,799 | 3/1937 | Creswell | 273/308 |

*Primary Examiner*—Anton O. Oechsle

*Attorney, Agent, or Firm*—William J. Daniel

[57] ABSTRACT

A card game for teaching family relationships made up of a first group of cards carrying indicia, such as a name alone or in conjunction with an appropriate illustration, corresponding to the individual members of plural, preferably three, adjacent generations of a family and including a plurality of cards for each such member; and a second group of cards carrying indicia descriptive of the relationships existing between any pair of different family members within these plural generations from the perspective of the particular player of the game and including a plurality of such cards for each such relationship for controlling during play the association of the family member cards in a predetermined pattern.

6 Claims, 3 Drawing Figures

FAMILY RELATIONSHIPS CARD GAME

CROSS-REFERENCE TO RELATED APPLICATIONS

This application is a continuation-in-part of application Ser. No. 850,396, filed Nov. 10, 1977, abandoned.

FIELD OF THE INVENTION

This invention relates to a card game having both educational and instructional values and is concerned more particularly with a card game designed to provide instruction in family relationships, especially for young children, in the context of entertaining and competitive game play.

BACKGROUND OF THE INVENTION

In earlier generations, the social organization of the family was such as to result in the exposure of young children to older relatives outside their immediate family as a natural consequence of repeated personal contact and interaction. Thus, in a typical situation, a family would become established in a given locale, and as the children of this family matured, they would create new families which would in turn settle nearby, and the individuals throughout this family chain would have frequent, virtual day to day, contact with one another so that the younger members would from this natural process acquire a definite understanding of their role in the extended family chain and their relationship to more remote members of that chain.

With the increased mobility of society in current times, mainly as a result of almost universal access to the automobile, the pattern of earlier days rarely is followed; in distinct contrast, the tendency is for children of a given root family to create their own families in areas distant from the root family. Therefore, the families of later generations tend to evolve in a more or less isolated state with at most only occasional personal contact with immediate family members of earlier generations and even less contact with more distant family members. Indeed, this tendency is so pronounced in modern society that social observers have coined the phrase "nuclear family" to connote the isolated self-contained condition of modern families. As a consequence of this different social pattern, the children of such "nuclear families" have little exposure to family members of earlier generations and, therefore, have little opportunity to develop a clear understanding of how the members of a family chain are related, the real meaning of such relationship and how they personally fit into this chain.

OBJECTS OF THE INVENTION

The primary object of this invention is to provide a card game which in the course of its play will aid in conveying to the players a clear sense of the manner in which the individual members of plural generations of a family chain are related to one another.

It is also an object of this invention to provide a card game incorporating the competitive spirit typical of such games so that its instructional aspects are disguised but will be naturally imparted in the competitive spirit of play.

BRIEF DESCRIPTION OF THE DRAWINGS

These and other objects of the present invention will be revealed by the following detailed description when read in conjunction with the accompanying drawings in which:

FIGS. 1 and 2 illustrate respectively the two basic groups of cards which constitute the deck of cards of the invention by way of selective illustrative examples of the cards contained within each such group; while

DETAILED DESCRIPTION OF THE INVENTION

Figure 1:
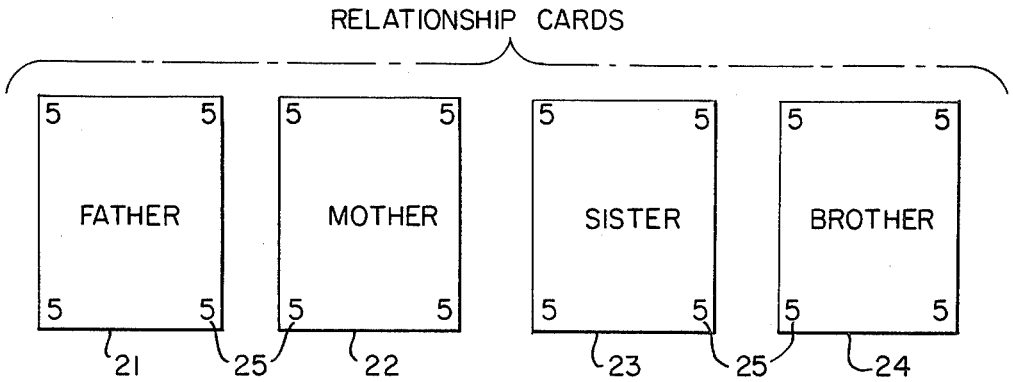

In general, the card game of the present invention is constituted by a deck of cards, formed of the same stiff sheet material ordinarily employed for playing cards, which is constituted of two basic types or groups of cards. The first such group will carry on one face, i.e. the obverse face, of the cards thereof indicia, i.e., markings, printing or the like, representative or denotive of the indiviudual family members forming part of a plurality or series of adjacent family generations and will be subsequently referred to as the "indivudal" or "personality" group of cards. The style and form of such indicia may, of course, vary, one simple form being a word designation corresponding to the particular individual family member which a given "individual" card is intended to represent. If desired, these word designations could be accompanied by visual illustrations or depictions suggestive of a stereotype of the individual family member (which depictions are not shown in the drawings) and such stereotypic depictions could naturally be adapted to any cultural or ethnic group for which a particular set of cards might be designed.

Figure 2:
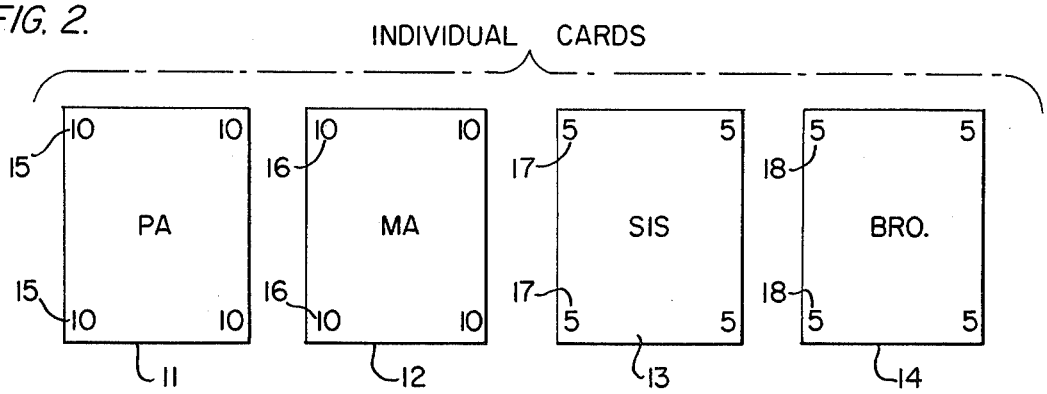

FIG. 2 illustrates a simple style or arrangement for the cards of the "individual" group, there being shown in this figure only four examples of such cards which are obviously not by any means intended to include all of the conceivable possibilities. It is preferred although not essential that each card of the "individual" group carry at an appropriate location thereon, for instance the four corners thereof, as indicated in the cards of FIG. 2, additional indicia denoting scoring values which can be used in determining the winner of a particular series of play. Most preferably, higher scoring values are given for certain particular family members, for instance, for originating members of the earliest generation of the series who can be considered as the "root members" of the family chain. The magnitude of these scoring values for any of the cards is widely variable.

In FIG. 2, the numerals 11 and 12 designate the "Pa" and "Ma" cards of the individual group, while the numerals 13 and 14 designate the "Bro" and "Sis" cards. Each of these cards has scoring values printed on the corners thereof as at 15, 16, 17 and 18, respectively. The scoring values for cards 11 and 12 are double those of cards 13 and 14.

A variety of different names is available to designate the individual members of a family chain and the following is a representative listing, with some alternatives in parentheses, which is by no means intended to be exhaustive of all conceivable possibilities; an exemplary scoring value is associated with each of these names for illustrative purposes:

| Individual | Scoring Value |
|---|---|
| Pa (Pop) | 10 |
| Ma (Mom) | 10 |
| Grandpa (Grampa) | 10 |

-continued

| Individual | Scoring Value |
|---|---|
| Grandma (Gran) | 10 |
| Auntie | 5 |
| Unc | 5 |
| Sis | 5 |
| Bro (Jr.) (Buddy) | 5 |

If the game of the invention is to be played by multiple players as will usually be the case, a plurality of cards for each of the individual family members included must be provided so that each player can have access to each kind, and the number of cards for each kind of individual can be the same or they can be different in order to increase the level of difficulty in play. For example, fewer cards might be provided for the "root members" having the highest scoring values than for the cards corresponding to the other family members.

In a variation, the "individual" card group could include a card designated "ME", i.e. corresponding to the particular player, and a special high scoring value could be attached to this card to encourage its play and thereby emphasize the significance of the relationship of the individual player to the cards corresponding to other family members.

The cards in the individual group must cover at least two adjacent generations and, optimally, a series of at least three or more generations, unless the particular game is designed for very young players in which case two generations might suffice. Since a plurality of cards is desirable for each individual member of each generation, it is evident that the total number of cards would become unwieldy unless restrictions are placed on the number of generations and/or the variety of individual family members within a given generation.

The second group of cards making up the game of the invention carries indicia identifying the relationship that exists between any given pair of different family members within the extended family chain, and these cards will be herein designated as the "relationship" group. The relationship being identified by the second group of cards is, of course, determined from the perspective or viewpoint of the particular individual player of the game. The purpose or function of the cards of the "relationship" group is to determine or control the play of the individual cards in whatever pattern of play might be decided upon. These indicia will normally take the form of word designations which are descriptive of the particular relationship existing between a given pair of amily members and during play the proper "relationship" card will serve to "connect" two "individual" cards of the appropriate kind. Scoring values could likewise appear on the "relationship" cards in order to increase the magnitude of the scoring count available at the end of play or such values could be omitted, leaving the relationship cards "neutral" in terms of scoring count. Here again, where the game is intended for multiple players, a plurality of cards corresponding to each relationship needs to be provided and the possibility of increasing the number of cards to unwieldy proportions again should be borne in mind.

The following is a listing of conceivable terms descriptive of family relationships and as before this listing is not intended to be exhaustive or all inclusive. For illustration sake, the same scoring value is associated with each of the relationship names, but this value is variable at will:

| Relationship | Scoring Value |
|---|---|
| Father | 5 |
| Mother | 5 |
| Grandfather | 5 |
| Grandmother | 5 |
| Aunt | 5 |
| Uncle | 5 |
| Sister | 5 |
| Brother | 5 |
| Son | 5 |
| Daughter | 5 |
| Wife | 5 |
| Husband | 5 |

In FIG. 1, the numbers 21–24 designate foud kinds of exemplary "relationship" cards, namely, "Father", "Mother", "Sister" and "Brother", respectively, and each of these four kinds of cards carries identical scoring values of an arbitrary magnitude, as at 25.

From a comparison of the aforegoing listing of individual and relationship names, it becomes obvious that in certain instances it becomes difficult to identify names for family members that are suggestive of relationship without at the same time being suggestive of a family member as an individual or person. To avoid any confusion in this regard, the two groups of cards could be distinguished by means or color or other designation so that it would be clear when a given card is intended to designate a relationship instead of an individual and vice versa. Alternatively, it would be entirely acceptable for certain cards to be playable in either group at the option of the player, for example cards designated niece and nephew, and these cards might be considered as "wild" cards in the manner of many card games.

Obviously, many variations are possible. For instance, it might be possible for a deck of cards to be "customized" on special order so that the actual given Christian names of the individuals of a particular family could appear in printed form along with the more generalized indicia. As an alternative, the cards can be provided with an erasable surface, for instance by means of a plastic coating, on which the given family names could be written with a removable grease pencil or the like. In these ways, the play of the game could be made more personal with an added level of excitement.

Figure 3:
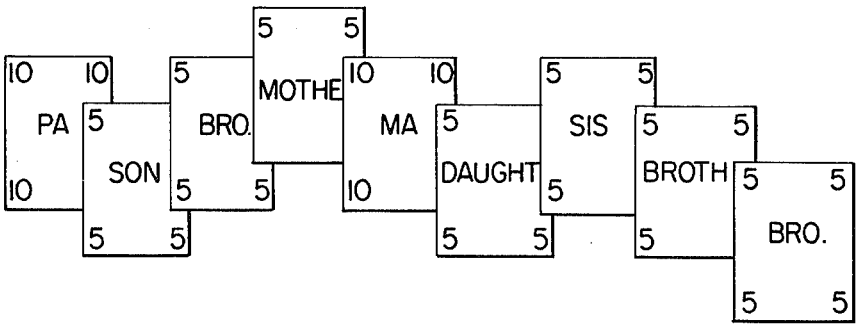
FIG. 3 illustrates one way in which the game of the invention might by played.

There are imaginable any number of patterns of play for the card game of the present invention. One pattern might follow the general style of "solitaire", as illustrated in FIG. 3, in which a "root family" card is necessary to begin a chain of cards. Starting from this root family card, other individual member cards could be added to the chain provided that an appropriate relationship card was first placed on the root member card and every subsequent individual card so as to connect the two adjacent individual cards in their proper relationship. Thus, with reference to FIG. 3, the game would start with the "Pa" card as the root card. In order for a "Bro" card to be played, a "Son" card must be in the possession of the player and played simultaneously since the players brother would necessarily be the son of the players father. Assuming that a "Ma" card was held by the player, the "Ma" card could be played only in conjunction with a "Mother" card since the player's "Ma" would necessarily be the mother of the player's brother. Continuing the sequence, a "Sis" card could be played only with a "Daughter" card inasmuch as the player's sis is the daughter of the player's ma and, likewise, a "Bro" card would require a "Brother" relationship card, as the player's bro is the brother of the player's sister. Obviously, the identity of the individual cards as well as the relationship of the relationship cards are selected from the perspective or viewpoint of each individual player in order to fulfill the basic objective of the present game of instructing each individual player as to his place in the family chain.

Alternatively, the pattern of play could follow the style of "gin rummy" in which groups of three, five or more cards (not illustrated in the drawings) constituted of a pair or a series of pairs of individual cards with each pair connected by an appropriate relationship card, could be exposed on the playing surface in front of the player as each such group was completed.

In each of the examples of patterns of play, a "hand" of cards could initially be dealt to each player in a given game, followed by the drawing of additional cards from the top of the "deck" as the play progresses around the players. Variations on these patterns as well as completely different patterns of play are imaginable to those skilled in the art of card games.

The reverse surface of the cards in the present game could be left plain or they could be printed with an attractive design as is typical. Following the normal style of card games, the cards of the present invention might well be rectangular in shape but they could equally be round or polygonal in configuration if preferred. For very young children, the card size could be increased to simplify handling and the indicia designations printed in large size type or in a phonetic style to assist in increasing the word recognition and pronounciation skills of this category of players. Other modifications and variations are readily possible and are not intended to be excluded from the scope of the invention except as may be required by the wording of the appended claims.

What is claimed is:

1. A card game adapted for teaching family relationships comprising a first distinctive group of cards carrying indicia identifying the individual members of plural generations of a family and including a plurality of cards for each such member; and a second group of cards distinctive from the first group each carrying indicia descriptive of the relationship existing between a given pair of different family members within said plural generations from a player's perspective and including a plurality of such cards for each such relationship for linking during play the association of pairs of said family member cards in a predetermined pattern.

2. The card game of claim 1 wherein the cards in at least said first group also carry indicia values for scoring the cards associated in said pattern.

3. The card game of claim 2 wherein certain individual members of the earliest of said plural generations are designated as "root" family members and the scoring values carried on the corresponding cards of said first group are higher than on the remaining cards of said first group.

4. The card game of claim 1 wherein said first group of cards includes the members of at least three generations of family members.

5. The card game of claim 1 wherein the indicia carried on each card of said first group includes an illustration generally characteristic of the individual family member to which said card corresponds.

6. The card game of claim 1 including certain cards carrying designations appropriate to either of such groups which can be played in either such group as "wild cards".

* * * * *